US009016533B2

(12) United States Patent
Visalli et al.

(10) Patent No.: US 9,016,533 B2
(45) Date of Patent: Apr. 28, 2015

(54) WEAPON SAFETY DEVICE

(71) Applicant: Relativity Engineering LLC, Chicago, IL (US)

(72) Inventors: Brian Visalli, Tinley Park, IL (US); Darren Bodner, Chicago, IL (US); Joel Young, Lockport, IL (US); Jacob Evans, Chicago, IL (US); Helene Seltzer, Manhattan, IL (US); Thomas Larson, Chicago, IL (US); Daniel Visalli, Charlotte, NC (US)

(73) Assignee: Relativity Engineering, LLC, Chicago, IL (US)

( * ) Notice: Subject to any disclaimer, the term of this patent is extended or adjusted under 35 U.S.C. 154(b) by 0 days.

(21) Appl. No.: 14/206,358

(22) Filed: Mar. 12, 2014

(65) Prior Publication Data

US 2014/0263497 A1 Sep. 18, 2014

Related U.S. Application Data

(60) Provisional application No. 61/783,143, filed on Mar. 14, 2013.

(51) Int. Cl.
*F41C 33/00* (2006.01)
*F41C 33/02* (2006.01)

(52) U.S. Cl.
CPC ..... *F41C 33/0263* (2013.01)

(58) Field of Classification Search
USPC ..... 224/192, 912, 193, 198, 238, 243, 244, 224/911; 70/30, 57; 42/66, 70.11
See application file for complete search history.

(56) References Cited

U.S. PATENT DOCUMENTS

| | | | |
|---|---|---|---|
| 5,261,177 | A | 11/1993 | Armstrong |
| 5,322,200 | A | 6/1994 | Blanchard |
| 5,621,996 | A | 4/1997 | Mowl, Jr. |
| 7,478,724 | B2 | 1/2009 | Vor Keller |
| 2012/0285063 | A1 | 11/2012 | Woodford |

OTHER PUBLICATIONS

PCT International Search Report, dated Jul. 14, 2014; 9 pages.

*Primary Examiner* — Brian D Nash
*Assistant Examiner* — Corey Skurdal
(74) *Attorney, Agent, or Firm* — Seyfarth Shaw LLP

(57) ABSTRACT

Disclosed is a safety device that maintains a weapon inside a holster in a locked state without requiring the gun to be removed from the holster beforehand. In the embodiments, a single safety device can be used on a variety of holsters to lock the gun inside the holster, without requiring removal of the gun from the holster, therefore preventing children or other unauthorized individuals from accessing the gun and the gun's trigger.

10 Claims, 13 Drawing Sheets

WEAPON SAFETY DEVICE

CROSS-REFERENCE TO RELATED APPLICATIONS

The present application claims priority to provisional application No. 61/783,143, filed Mar. 14, 2013, the contents of which are hereby incorporated by reference in their entirety.

TECHNICAL FIELD OF THE INVENTION

The present application relates to weapon safety devices. Particularly, the present application relates to a weapon safety device for retaining a weapon in a holster.

BACKGROUND OF THE INVENTION

Weapon safety is an ever-growing issue in today's society. Many public officials and private citizens carry firearms on a consistent basis and need to remove their firearms from their holsters when using, maintaining, or locking their firearm. In general, it is difficult or impossible to shoot a gun when the weapon is properly retained within a holster. Accordingly, removing the gun from the holster creates the danger of an accidental discharge.

In 1997, President Clinton issued a mandate to all federal officials carrying firearms. Clinton's mandate, which is still in effect, required all federal agencies to provide a gun lock when issuing a firearm to a public official. The goal of the mandate was to limit the number of loaded guns that fell into the hands of children. With a gun lock, even if a child were to pick up a loaded gun, the child would be unable to discharge the gun because the trigger would be locked in a safe position.

Current gun locks have become widespread since Clinton's mandate. However, current gun locks are burdensome, clumsy, and require the gun to be removed from the holster so the lock can be installed. In many ways, gun locks currently on the market increase firearm danger by requiring federal officials to remove their gun from the safety of the holster when locking the trigger in a safe position.

SUMMARY OF THE INVENTION

The present application discloses a safety device for a weapon, for example, a gun, that maintains the gun in a safe position without requiring the gun to be removed from the holster in which it is retained. For example, the present application discloses a safety device that fits over the holster and does not allow removal of the gun from the holster or access to the gun's trigger without a corresponding key or other unlocking means. The gun can therefore remain in the holster rather than dangerously being removed, and can be locked using a convenient safety device that keeps the gun away from children or other unauthorized individuals.

In particular, the present application discloses a safety device for retaining a weapon secured within a holster, including a base, a lock disposed in the base, and a cord removably coupled to the base and adapted to be selectively retained by the lock to firmly retain the weapon and holster against the base.

The present application also discloses a retaining system including a weapon, a holster retaining the weapon, a safety device adapted to retain the weapon within the holster, the safety device including a base, a lock disposed in the base, and a cord removably coupled to the base and adapted to be selectively retained by the lock to firmly retain the weapon and holster against the base.

Also disclosed is a method of securing a weapon including placing the weapon in a holster, placing the holster in a safety device, wherein the safety device includes a base, a lock disposed in the base, and a cord removably coupled to the base and adapted to be selectively retained by the lock to firmly retain the weapon and holster against the base, and locking the lock to retain the weapon and the holster in the safety device.

Further disclosed is a weapon safety device including a base, the base including a barrel portion located proximate a barrel of a weapon, a trigger portion adapted to cover a trigger of the weapon, and a lock portion having a lock and adapted to close the base upon itself to form a partially or fully-enclosed housing that retains the weapon within a holster.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
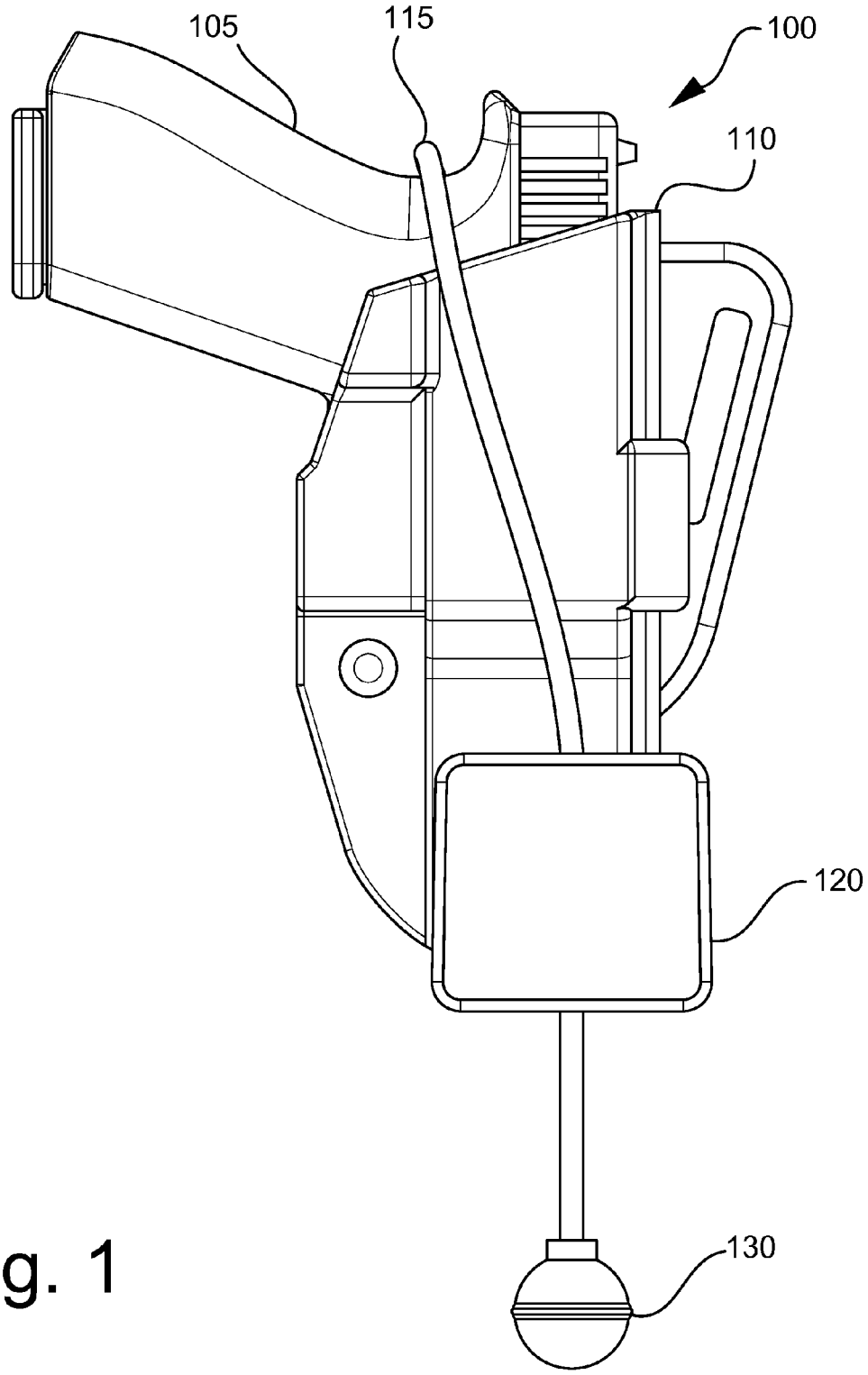
FIG. 1 is an illustration of a safety device retaining a gun in a holster in accordance with embodiments of the present application.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated.

The present application discloses a safety device that maintains a weapon, for example, a gun, inside a holster in a locked state without requiring the gun to be removed from the holster beforehand, therefore prohibiting access to the gun's trigger. The safety device can be a separate component from the holster that is capable of locking a variety of holsters and guns, or can alternatively be a custom component for each unique holster. In an embodiment, a single safety device can be used on a variety of holsters to lock the gun inside the holster, without requiring removal of the gun from the holster, therefore preventing children or other unauthorized individuals from accessing the gun and the gun's trigger.

Figure 2:
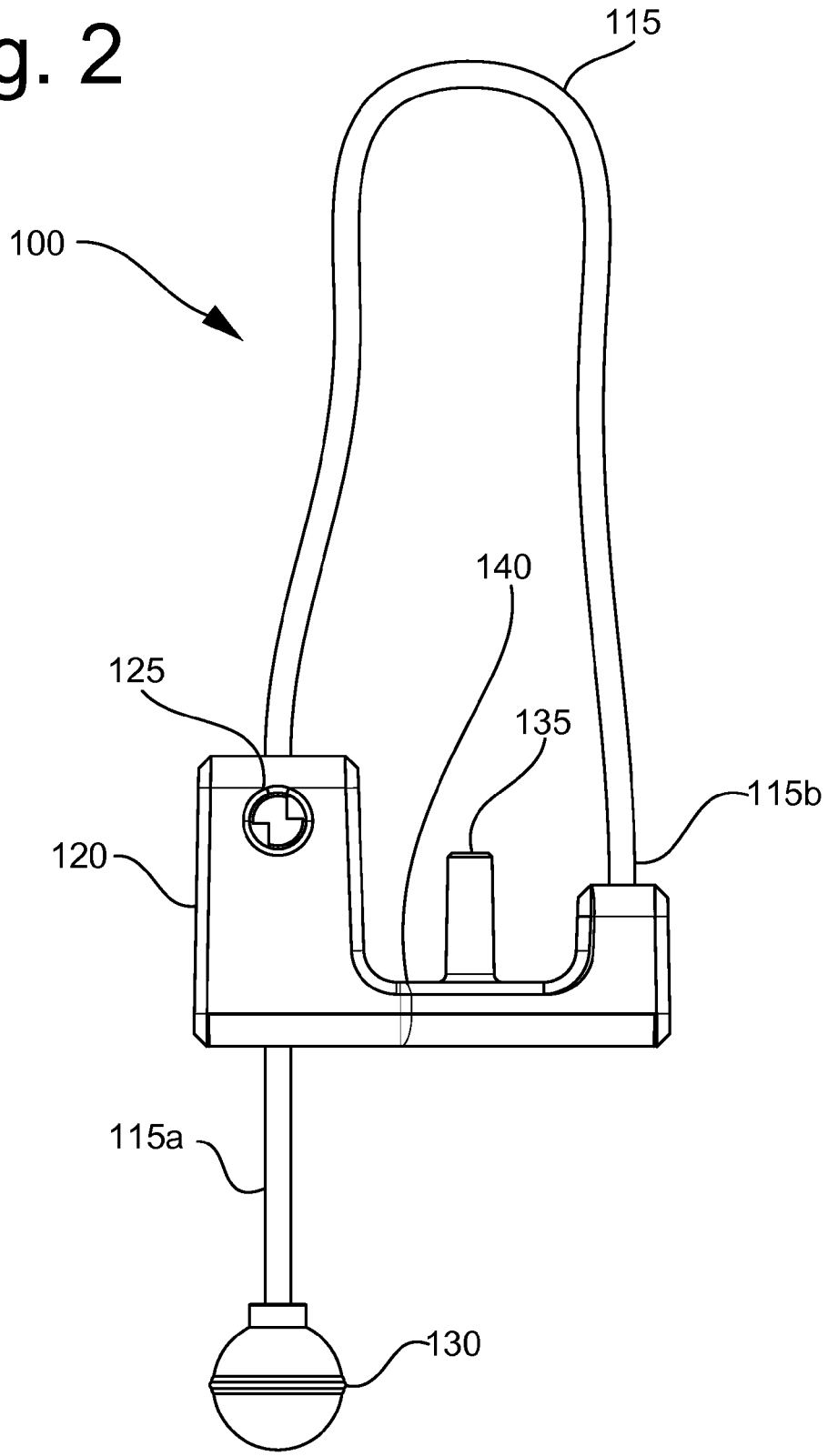
FIG. 2 is an illustration of a safety device in accordance with embodiments of the present application.

As shown, FIG. 1 discloses a safety device 100 adapted to retain a weapon 105, such as a gun, in a holster 110. The safety device 100 can include a cord 115 that extends around the butt of the gun 105 and that couples with a base 120 to lock the gun 105 in the holster 110. As shown in FIG. 2, the cord 115 can include a first cord end 115*a* and a second cord end 115*b* opposite the first cord end 115*a*. The first cord end 115*a* can lockingly couple with the base 120 when retained by a lock 125, and the second cord end 115*b* can be fixed within the base 120. Optionally, a handle 130 can be provided on the cord 115 at the first cord end 115*a* to allow for easier handling of the cord 115 by a user. A plug 135 can be disposed on the base 120 for receiving the barrel of the gun and position the gun on the base 120.

The cord 115 can be made of any material and can be flexible or rigid, as desired. In an embodiment, the cord 115 is made of flexible steel that can be easily removed from the base 120 when needed. Alternatively, the cord 115 can be made of a more flexible steel, such as the type used in conventional locks, rather than being constructed of a more rigid metal frame. Any other material can be used for the cord 115, including plastics, rubber, rope or any other structural material, without departing from the spirit and scope of the present application. The base 120 may similarly be any shape or size, and constructed of any material, without departing from the spirit and scope of the present application.

The lock 125 can be any mechanism that lockingly couples the cord 115 to the base 120, for example, a handcuff key lock, a combination lock, a standard key lock, a biometric lock, a radio frequency identification (RFID) lock, a wirelessly controlled electronic lock, or any other type of lock or releasable coupling mechanism.

The base 120 can also include a plug 135 that is received within a barrel of the gun 105 for so-called "open holsters" that include an opening proximate the barrel of the gun 105 to secure the holster 110 and gun 105 in a secure position within the base 120. The plug 135 can be flexible and press fit within the barrel of the gun 105, or can include any other receiving structure.

The base 120 can also include a receiving area 140 to cushion the impact of the gun 105 being inserted into the base 120. For example, the receiving area 140 can be made of rubber, soft fabric, or any other type of impact-receiving material.

Figure 3:
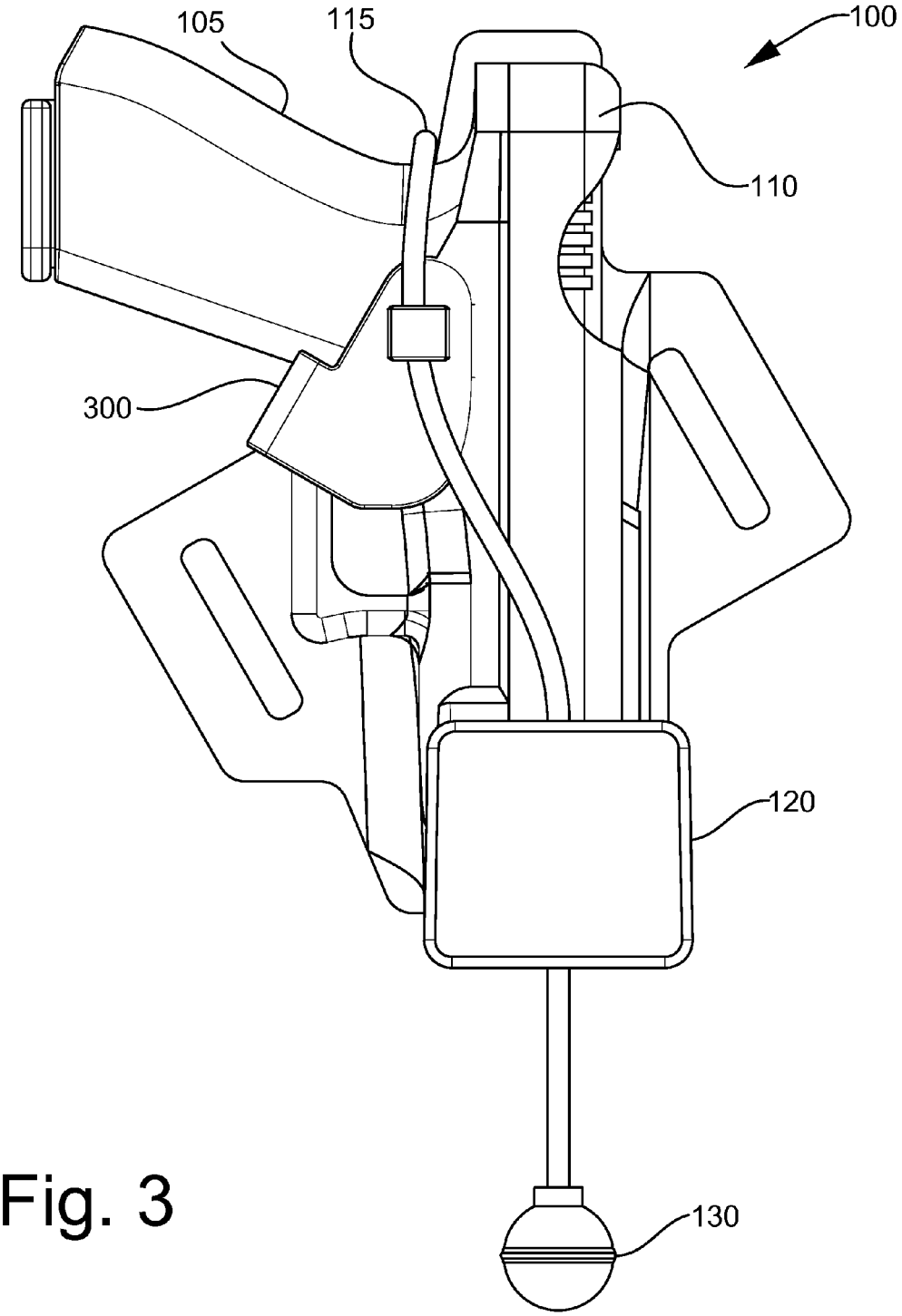
FIG. 3 is an illustration of another safety device retaining a gun in a holster in accordance with embodiments of the present application.
Figure 4B:
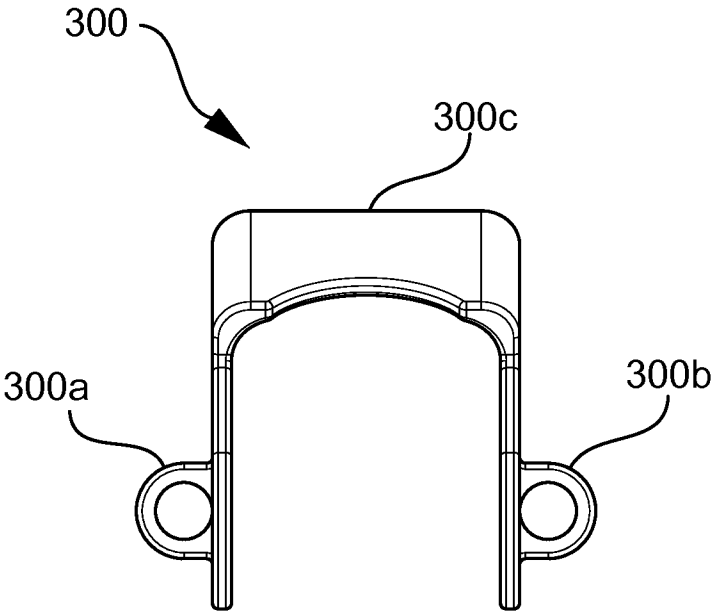
FIGS. 4A and 4B are illustrations of a trigger guard in accordance with embodiments of the present application.
Figure 4A:
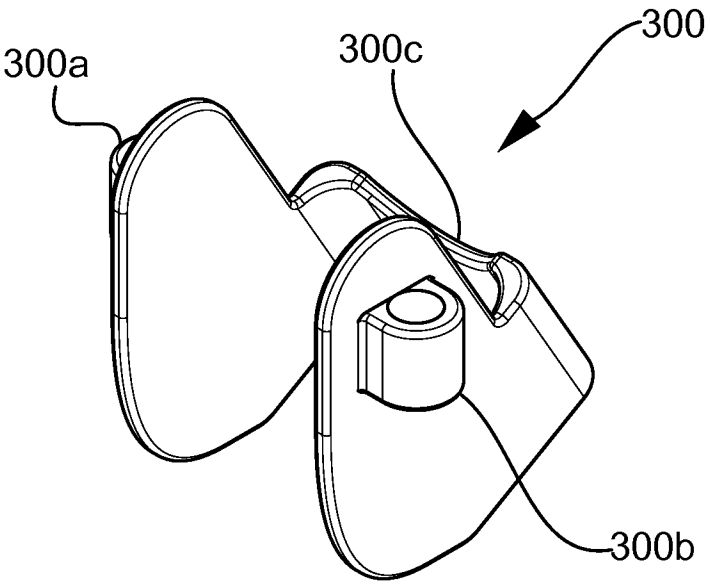
Figure 5:
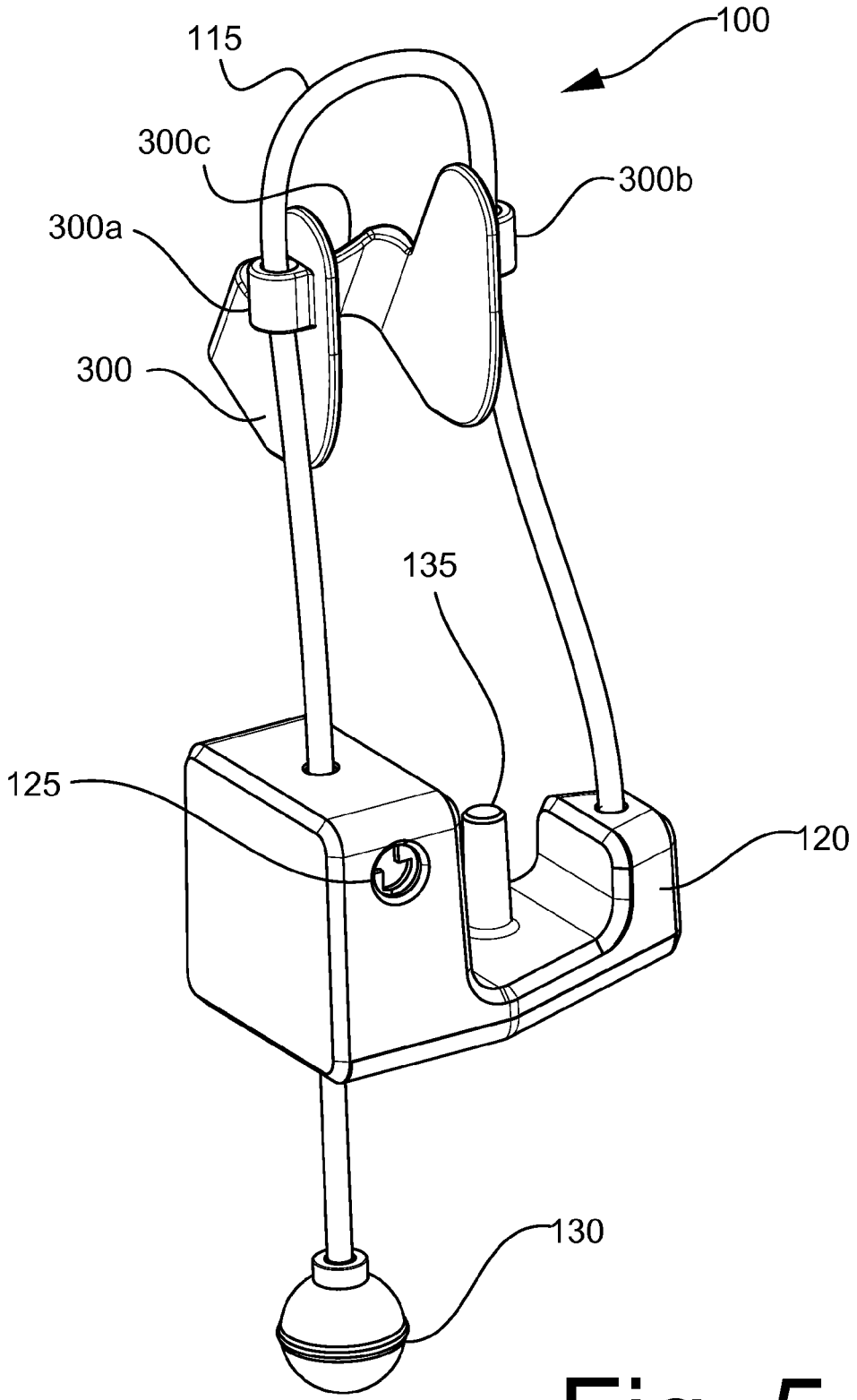
FIG. 5 is an illustration of a safety device having a trigger guard in accordance with embodiments of the present application.

FIGS. 3-5 illustrate an embodiment of the present application including a trigger guard 300 that covers an area of the gun 105 proximate the trigger to prevent access to the trigger. As shown in FIGS. 4A and 4B, the trigger guard 300 can include a first trigger guard end 300*a* and a second trigger guard end 300*b* adapted to receive the cord 115 to position the trigger guard 300 proximate the trigger. The first trigger guard end 300*a* and the second trigger guard end 300*b* can be connected together by a connecting portion 300*c*. The trigger guard 300 can be inserted onto the cord 115 by first inserting the second trigger guard end 300*b* over the cord 115, and subsequently inserting the first cord end 115*a* through the first trigger guard end 300*a*.

Accordingly, the trigger guard 300 can be retained against the trigger area of the gun 105 once the cord 115 is tightly coupled against the base 120. For example, the cord 115 can be tightened against the gun 105 and would pull the trigger guard 300 against the trigger area of the gun 105. Any other means of retaining the trigger guard 300 against the trigger area of the gun 105 can be implemented without departing from the spirit and scope of the present application.

Different holsters 110 have different shapes and material properties. For example, plastic holsters 110 can be stronger and more stiff than leather holsters 110, and can have shapes that cover the trigger of the gun 105, making a trigger guard 300 unnecessary for some plastic holsters. Leather holsters 110 can have flexible portions near the trigger of the gun 105 such that a person could reach the trigger and accidentally discharge the gun 105. Trigger guards 300 can therefore be more appropriate for leather holsters 105, but it should be appreciated that the trigger guard 300 can be implemented with any shape or size holster 110 without departing from the spirit and scope of the present application. Also, a different shape trigger guard 300 can be implemented with a different shaped holster 105 to allow the safety device to restrain virtually any holster 110 housing a gun 105.

Figure 6B:
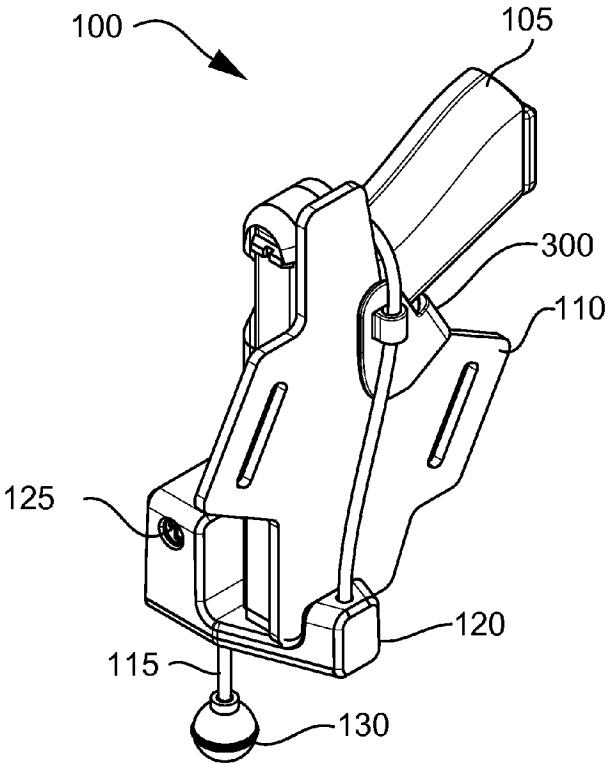
FIG. 6B is an illustration of a safety device retaining a gun in a first type of holster in accordance with embodiments of the present application.
Figure 6A:
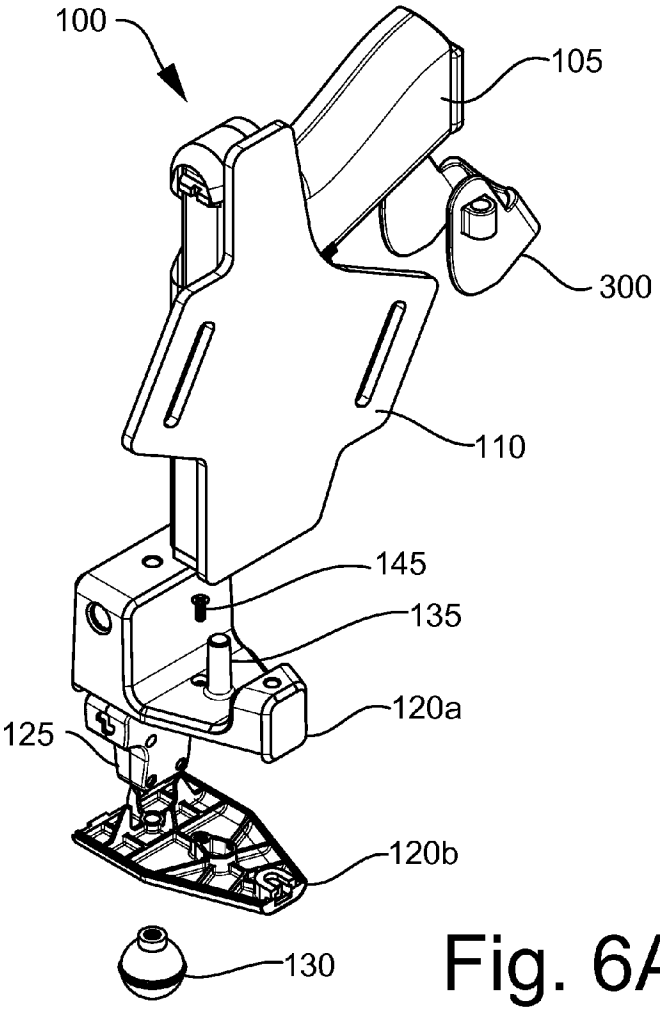
FIG. 6A is an exploded view of a safety device adapted to retain a gun in a first type of holster in accordance with embodiments of the present application.
Figure 7B:
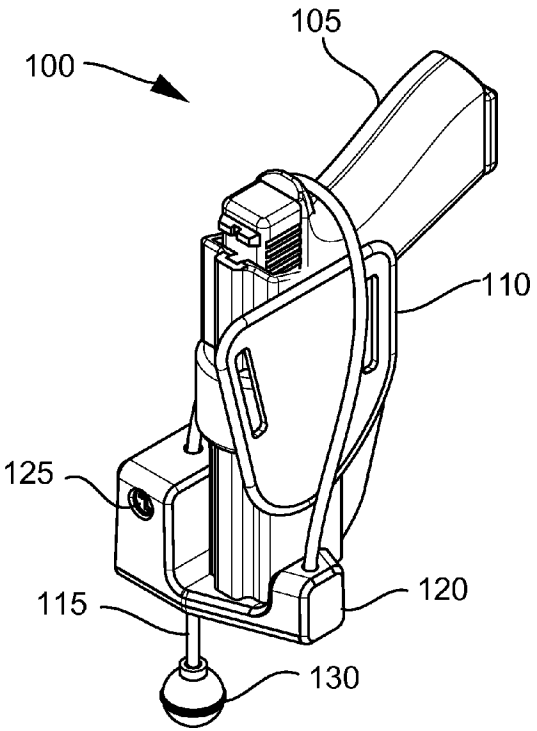
FIG. 7B is an illustration of a safety device retaining a gun in a second type of holster in accordance with embodiments of the present application.
Figure 7A:
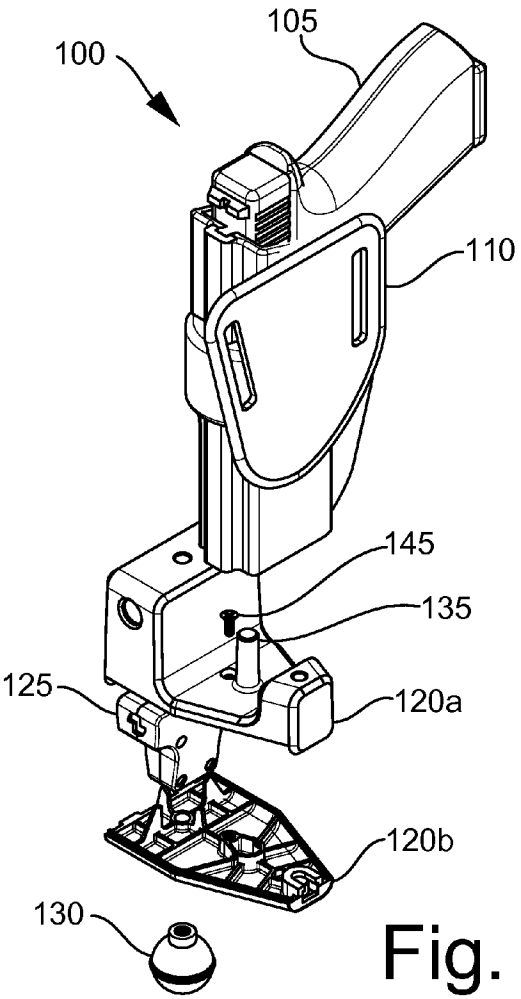
FIG. 7A is an exploded view of a safety device adapted to retain a gun in a second type of holster in accordance with embodiments of the present application.

FIGS. 6A and 6B illustrate a safety device 100 coupled around a gun 105 and first type of holster 110, whereas FIGS. 7A and 7B illustrate a safety device 100 coupled around a gun 105 and second type of holster 110. As shown, the holster 110 in FIGS. 6A and 6B benefits from the trigger guard 300, whereas the holster in FIGS. 7A and 7B already protects the trigger of the gun 105 and has less of a need for a trigger guard 300. For example, the holster 110 in FIGS. 6A and 6B can be a leather holster, whereas the holster 110 in FIGS. 7A and 7B can be a polymer or non-leather holster. Regardless, both holsters 110 can be used with the safety device 100, either by removing or attaching the trigger guard 300.

As shown in FIGS. 6A and 7A, the base 120 can be a two component element having a first portion 120*a* and a second portion 120*b* coupled together by a base fastener 145. The base 120 can house the lock 125 to allow easy replacement thereof, and allow for standard locks to be inserted into the base 120.

Figures 8A, 8B, 8C:
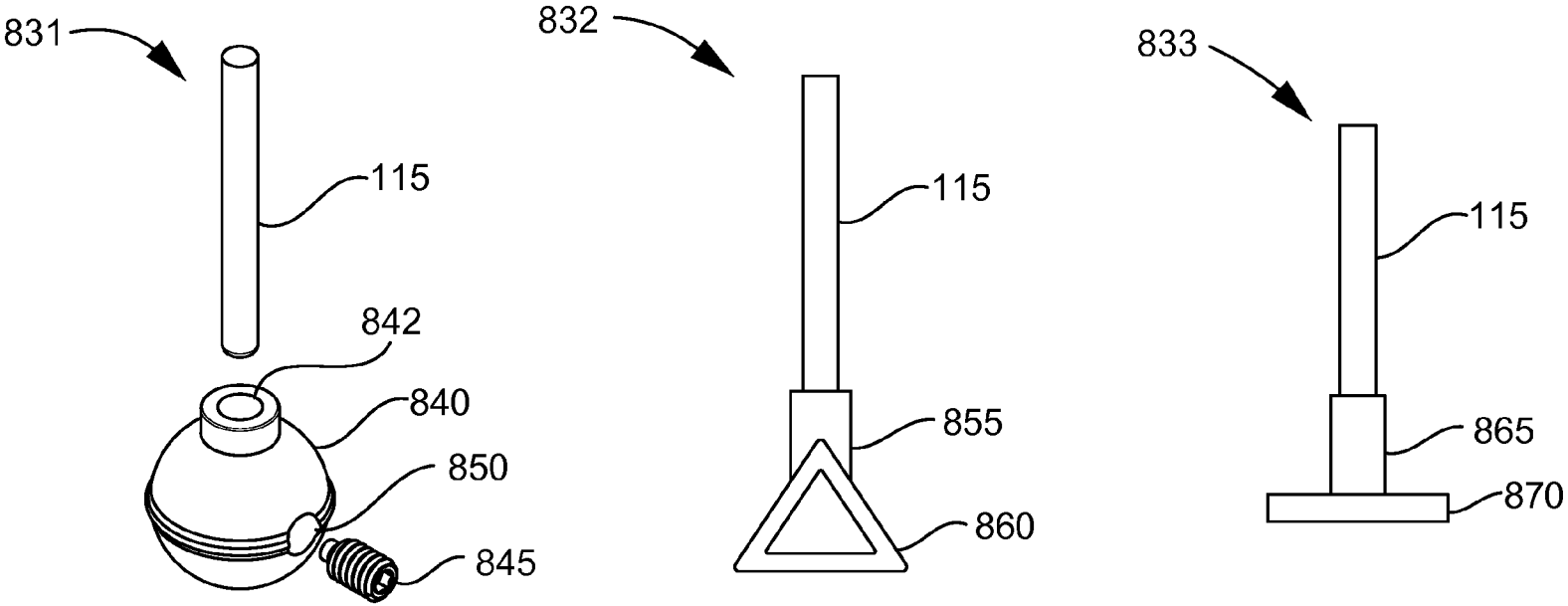
FIGS. 8A-8C are illustrations of handles in accordance with embodiments of the present application.

FIGS. 8A-8C illustrate different structures for use as the handle 130. As discussed above, the handle 130 can help the user guide the cord 115 through the base 120 and engage with the lock 125 to hold the gun 105 and holster 110 in place. Various structures can be used for the handle 130 to help the user grip the cord 115. As shown, a first handle 831 includes a ball 840 with an opening 842 for receiving the cord 115. An insert 845 can be inserted into the ball 840 through a hole 850 to couple against the cord 115. In FIG. 8B, a triangle handle 832 is shown with a triangle base 855 having a triangular attachment 860 coupled thereto for easier handling by the user. Similarly, as shown in FIG. 8C, a perpendicular handle 833 is shown having a handle base 865 and a perpendicular component 870 that is perpendicular to the handle base 865. Any other form of handle 130, or no handle 130 at all, can be implemented without departing from the spirit and scope of the present application.

Figure 9C:
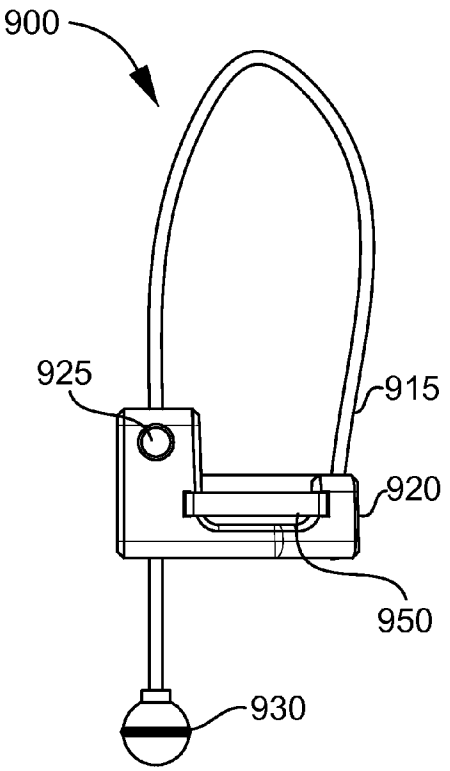
FIGS. 9A-9C illustrate an adjustable bracket safety device in accordance with embodiments of the present application.
Figure 9B:
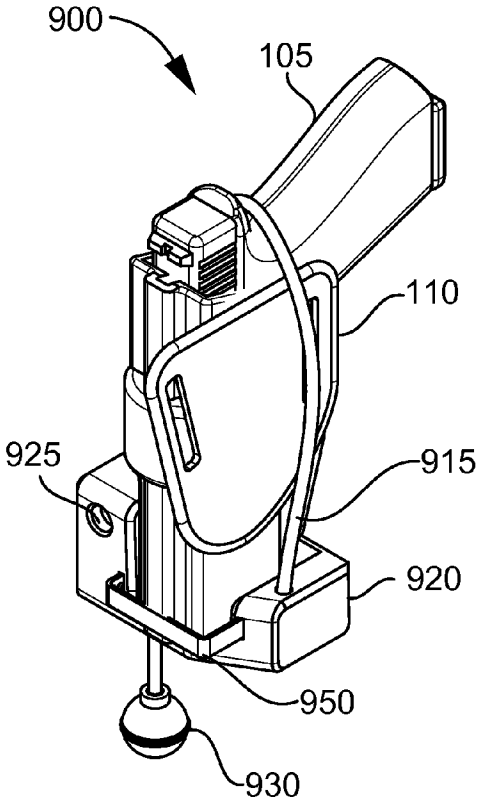
Figure 9A:
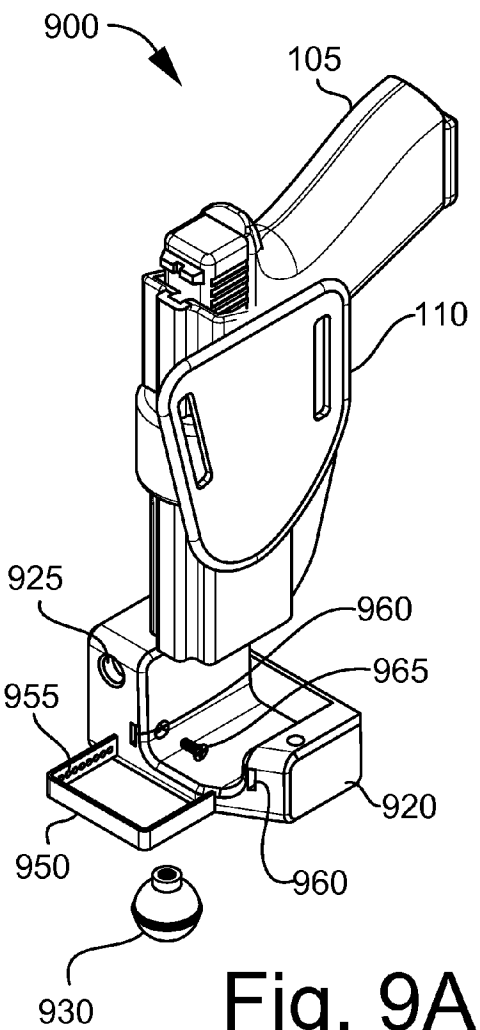

FIGS. 9A-9C illustrate an adjustable bracket safety device 900. As shown, the safety device 900 of FIGS. 9A-9C includes like elements with like numbering as compared to the safety device 100 of FIG. 1. However, the safety device includes an adjustable bracket 950 with receiving portions 955 adapted to insert into a pair of slots 960 and receive a set screw 965 or other form of fastener for adjustable movement of the bracket 950. In this manner, the gun 105 and holster 110 can be firmly maintained within the safety device 900 and a gun 105 and "open front" holster 110 can be maintained within the same lock 900 as a gun 105 and "closed front" holster. Any other form of the base 920 can be implemented without departing from the spirit and scope of the present application.

Figure 10B:
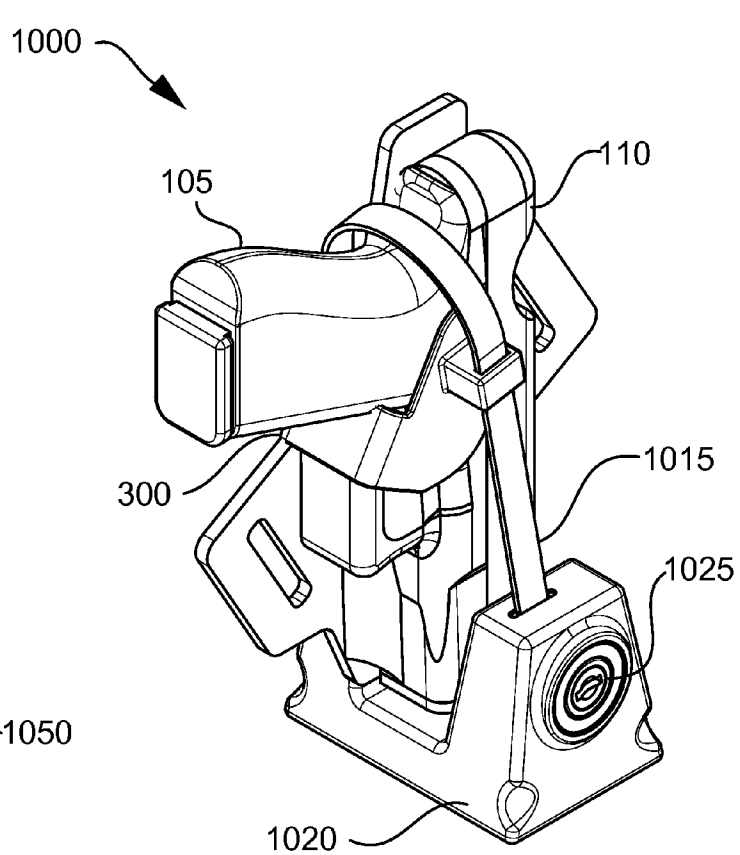
FIGS. 10A-10B illustrate a strap retention safety device in accordance with embodiments of the present application.
Figure 10A:
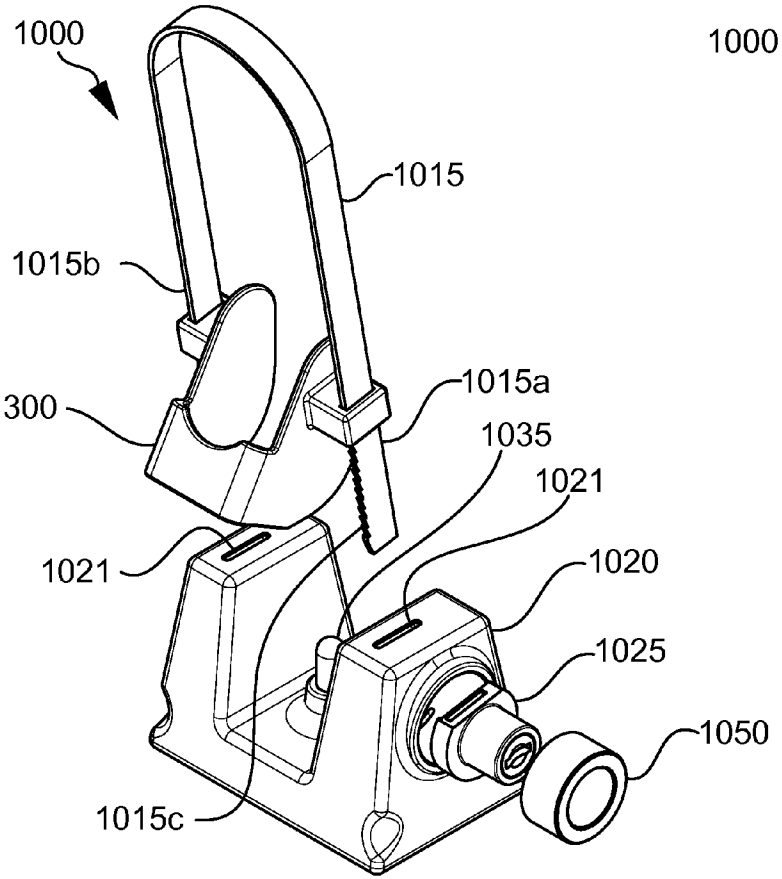

FIGS. 10A-10B illustrate a strap retention safety device 1000. The safety device 1000 includes like elements with like numbering as compared to the safety device 100 of FIG. 1, but includes a strap 1015 as the cord 115. The strap 1015 inserts into the base 1020 via base slots 1021 to retain the gun 105 and holster 110 in place. The strap 1015 can include a first strap end 1015*a* and a second strap end 1015*b*, where the first strap end 1015*a* includes teeth 1015*c* that insert into the base slot 1021 proximate the lock 1025 to hold the strap 1015 in place. The lock 1025 can further be housed by a cap 1050 to enclose the lock 1025 inside the base 1020. Similar to FIG. 1, the safety device 1000 can include a plug 1035, whereas the plug 1035 of FIGS. 10A and 10B is removable from the base 1020, in some embodiments.

Figure 11B:
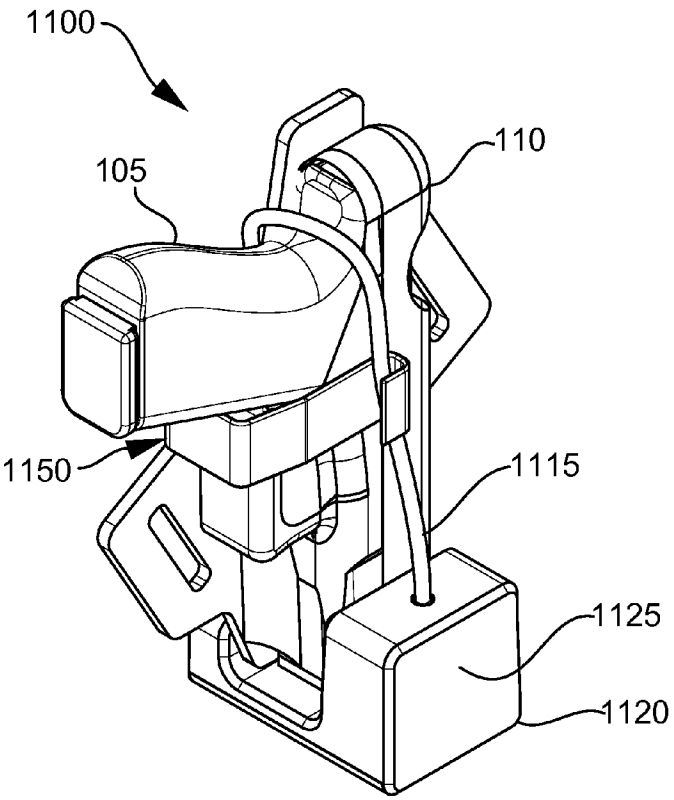
FIGS. 11A-11B illustrate a set screw cord and retention arm safety device in accordance with embodiments of the present application.
Figure 11A:
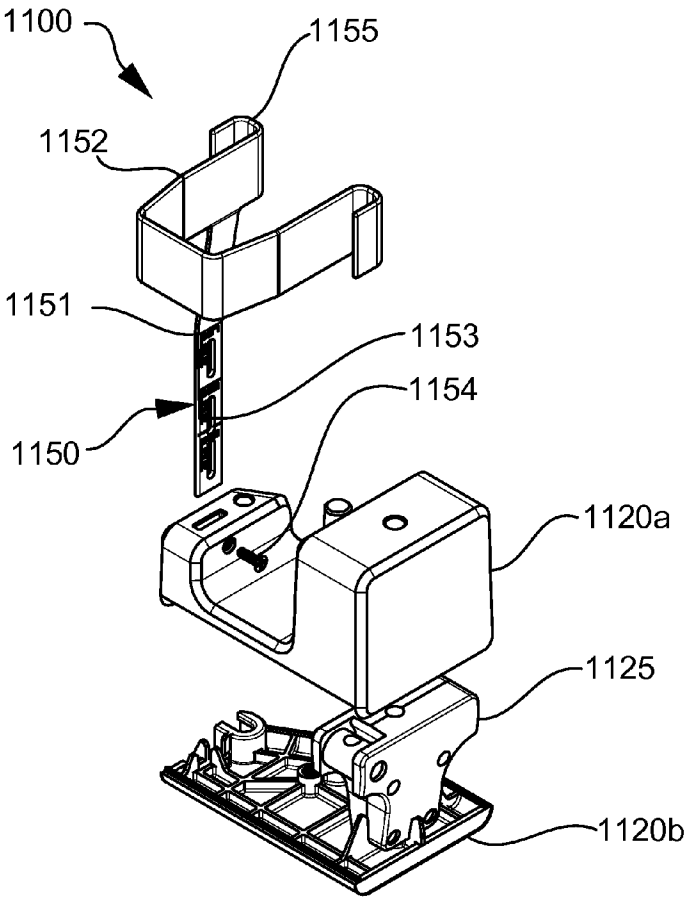

FIGS. 11A-11B illustrate a set screw cord and bracket safety device 1100. As shown, the safety device 1100 includes similar elements with like numerals as compared to FIG. 1. The safety device 1100 in FIGS. 11A-11B also includes a retention arm 1150 having an extending portion 1151 and a retaining portion 1152. The extending portion 1151 includes adjustment indents 1153 for receiving set screws 1154 or other fasteners to position the extending portion 1151 in place within the base 1120. The retaining portion 1152 includes cord receiving portions 1155 to receive the cord 1115 and firmly maintain the gun 105 and holster 110 in place, as shown in FIG. 11B. The retention arm 1150 can therefore fixedly remain in the base 1120, while the cord 1115 can firmly maintain the gun 105 and holster 110 in the base 1120 after being locked therein by the lock 1125.

Figure 12B:
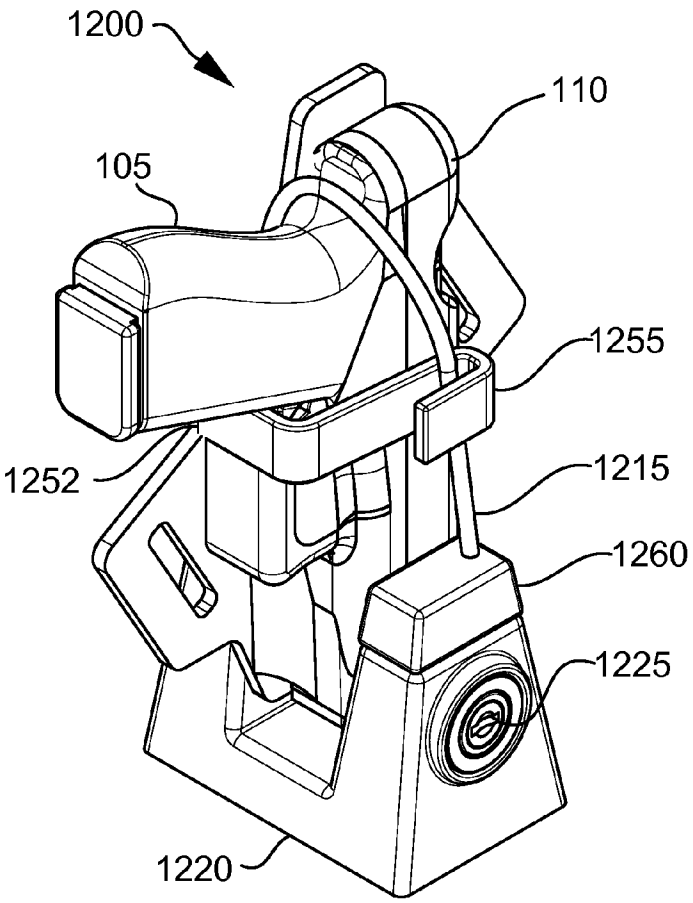
FIGS. 12A-12B illustrate a retention arm and lockable cord safety device in accordance with embodiments of the present application.
Figure 12A:
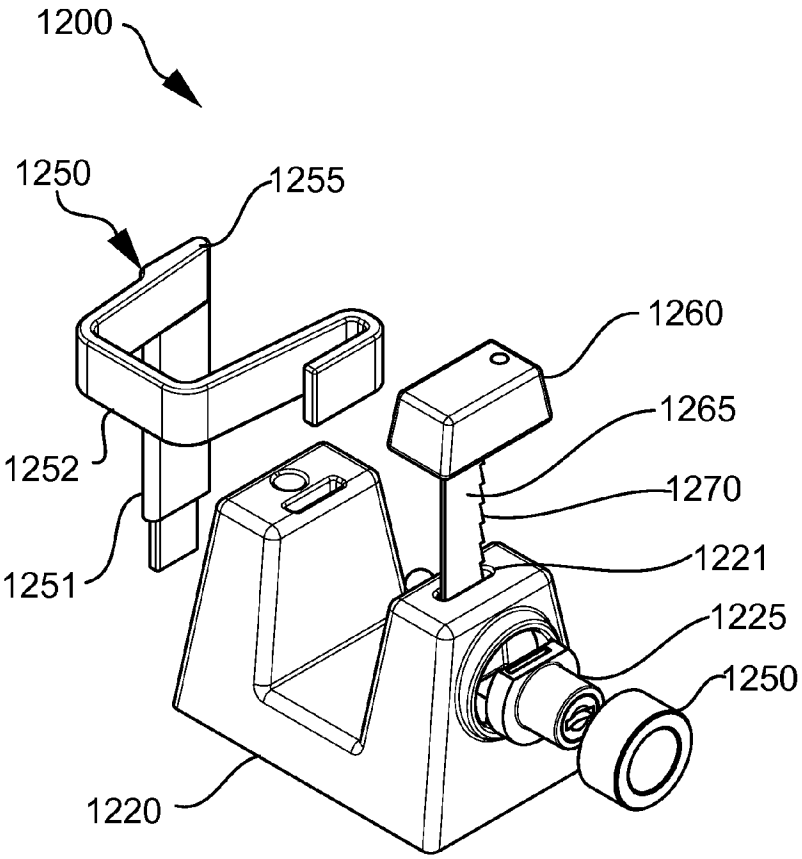

FIGS. 12A-12B illustrate a bracket and lockable cord safety device 1200 with like elements and like numerals as compared to the safety device 100 of FIG. 1. As shown, the safety device 1200 is similar to the safety device 1100 of FIG. 11, in that it includes a retention arm 1250 with an extension portion 1251 and a retaining portion 1252 having cord receiving portions 1255. The safety device 1200 also includes a base block 1260 adapted to adjustably insert into the base 1220 and be retained therein. For example, the base block 1260 can include a block extension 1265 with teeth 1270 that insert into a slot 1221 and lock into place via a lock 1225 covered by a cap 1250. The base block 1260 can receive the cord 1215 to firmly hold the gun 105 and holster 110 in place.

Figure 13B:
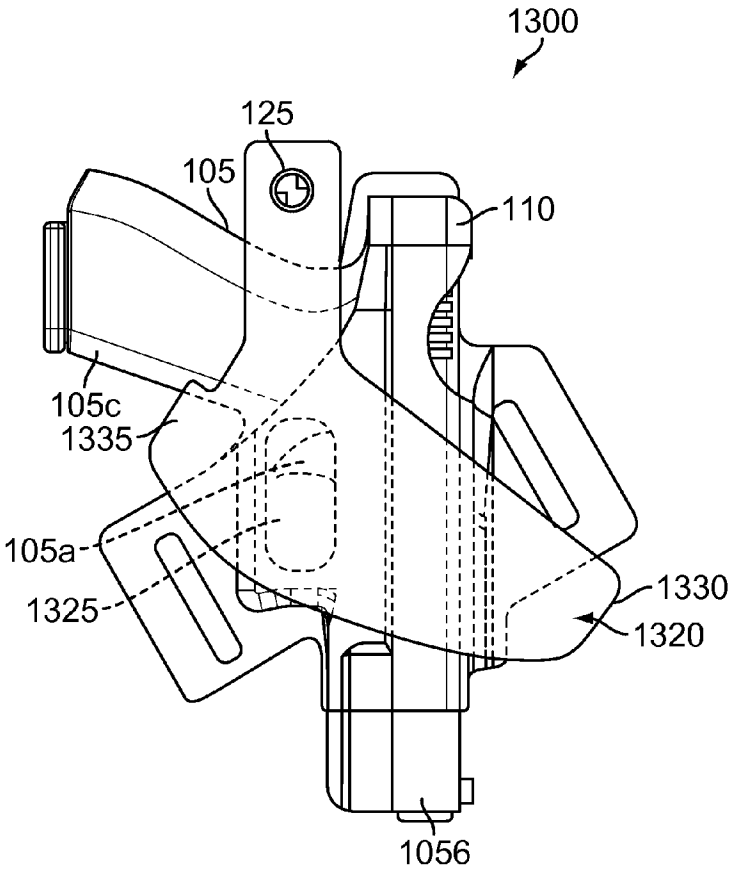
FIGS. 13A-13B illustrate cordless safety devices in accordance with embodiments of the present application.
Figure 13A:
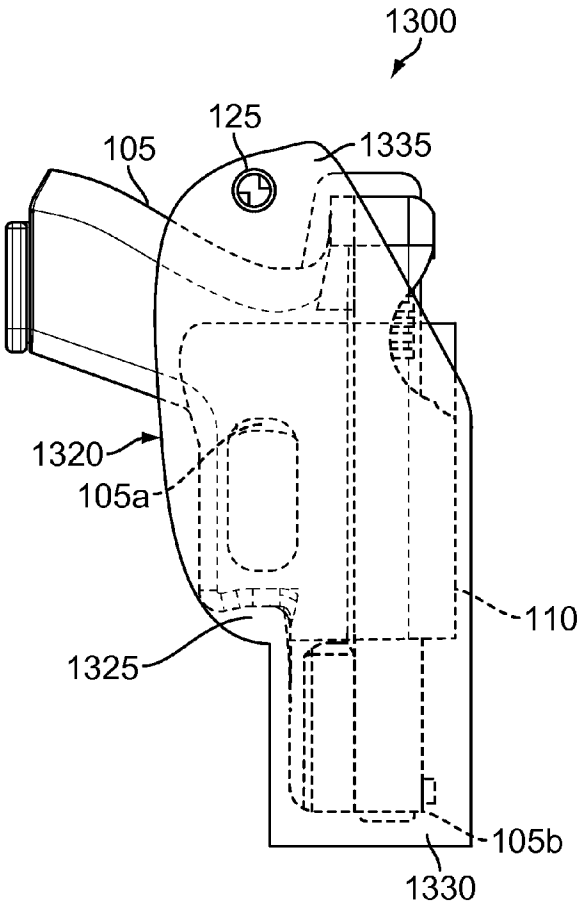

FIGS. 13A and 13B illustrate a cordless safety device 1300 where the base 1320 itself serves as the structural body that performs the locking function. The cordless safety device 1300 can, in some instances, be a custom shape to fit a particular model of holster 110. As shown in FIG. 13A, the cordless safety device 1300 can include a trigger portion 1325 for preventing access to the trigger 105*a* of the weapon 105, a barrel portion 1330 for covering the end of the barrel 105*b* of the weapon 105, and a lock portion 1335 having a lock 125 for locking the cordless safety device 1300 around the holster 110. As shown in FIG. 13B, however, the barrel portion 1330 need not cover the barrel 105*b* of the weapon 105 and can instead allow the barrel 105*b* to be exposed in the area where the holster 110 allows the barrel 105*b* to extend outside of the holster 110. Further, while the term "cordless" is used for description only, it is to be appreciated that a cord 115 could be used on the cordless safety device 1300, but that such is not absolutely necessary to lock the weapon 105 in the holster 110.

The lock 125 can connect the cordless safety device 1300 to itself to form an enclosed or partially-enclosed housing for the weapon 105 and holster 110 assembly. Further, the cordless safety device 1300 can include a butt portion 1335 adapted to contact the butt 105*c* of the gun proximate the trigger 105*a* and structurally maintain the weapon 105 in the holster 110.

As discussed above with respect to FIG. 1, the retaining element is a cord 115. However, the term "cord" in the following claims can refer to any of the above brackets, or the cord 115 itself.

As discussed herein, the safety device 100 is disclosed in various examples as being implemented with a gun 105. However, the inventions described in the present application can be implemented with any weapon or object so as to retain the object in a preferred configuration, and is not limited to only retaining guns. For example, the present application could also be implemented to secure a knife in its sheath in the same manner as the gun examples described above. In the claims below, the term "holster" can be interpreted as any structure that holds a weapon or object within, for example, a gun holster or sheath.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A retaining system for retaining a weapon comprising:

a holster that receives the weapon and structured such that a trigger of the weapon is at least partially exposed or accessible while the weapon is positioned in the holster, the holster extending to an end of a barrel of the weapon; and a safety device that retains the weapon within the holster, the safety device including:

a base;

a lock associated with the base; and a receiving area associated with the base and positioned to receive the holster while the weapon is located in the holster; and a cord removably coupled to the base and selectively retained by the lock to retain the weapon within the holster and against the base, the cord having first and second cord ends; and a trigger guard having at least one end slidably disposed along the cord and movable along the cord independent of the holster, the trigger guard movable to block access to the trigger of the weapon, wherein the safety device is adapted to be secured around the weapon and holster without requiring the weapon to be removed from the holster.

2. The retaining system of claim 1, wherein the weapon is a gun.

3. The retaining system of claim 1, wherein the trigger guard includes a first trigger guard end and a second trigger guard end each adapted to receive the cord, and the trigger guard further includes a connecting portion extending between the first trigger guard end and the second trigger guard end.

4. The retaining system of claim 1, wherein the first cord end is coupled to the base and the second cord end includes a handle.

5. The retaining system of claim 1, wherein the base includes a plug adapted to receive a barrel of the gun.

6. The retaining system of claim 1, wherein the base includes a first base portion and a second base portion adapted to house the lock.

7. The retaining system of claim 1, wherein the safety device further comprises an adjustable bracket adjustably coupled to the base and adapted to retain the weapon and the holster at the receiving area.

8. The retaining system of claim 1, wherein the cord is a strap.

9. The retaining system of claim 1, wherein the safety device further comprises a retention arm having an extension portion maintained within the base, and further having a cord receiving portion adapted to receive the cord.

10. The retaining system of claim 9, wherein the safety device further comprises a base block removably coupled to the base and retained in the base by the lock, the base block receiving the cord.

* * * * *